US011761121B2

(12) United States Patent
Ito et al.

(10) Patent No.: US 11,761,121 B2
(45) Date of Patent: Sep. 19, 2023

(54) METHOD FOR PRODUCING POLYACETAL FIBER

(71) Applicant: MITSUBISHI GAS CHEMICAL COMPANY, INC., Tokyo (JP)

(72) Inventors: Akira Ito, Tokyo (JP); Daisuke Sunaga, Mie (JP); Sunao Mikami, Mie (JP)

(73) Assignee: MITSUBISHI GAS CHEMICAL COMPANY, INC., Tokyo (JP)

( * ) Notice: Subject to any disclaimer, the term of this patent is extended or adjusted under 35 U.S.C. 154(b) by 688 days.

(21) Appl. No.: 16/628,808

(22) PCT Filed: Jun. 8, 2018

(86) PCT No.: PCT/JP2018/021957
§ 371 (c)(1),
(2) Date: Jan. 6, 2020

(87) PCT Pub. No.: WO2019/012876
PCT Pub. Date: Jan. 17, 2019

(65) Prior Publication Data

US 2020/0199787 A1 Jun. 25, 2020

(30) Foreign Application Priority Data

Jul. 14, 2017 (JP) ..... 2017-138148

(51) Int. Cl.
*D01F 6/66* (2006.01)
*D02G 3/32* (2006.01)
*D01D 5/12* (2006.01)

(52) U.S. Cl.
CPC ..... *D01F 6/66* (2013.01); *D01D 5/12* (2013.01); *D02G 3/324* (2013.01)

(58) Field of Classification Search
None
See application file for complete search history.

(56) References Cited

U.S. PATENT DOCUMENTS 3,536,219 A * 10/1970 Williams ..... D01F 6/66 264/290.5
3,978,192 A * 8/1976 Sussman ..... D01D 5/16 28/244

(Continued)

FOREIGN PATENT DOCUMENTS

CN 104499087 4/2015
CN 105401254 A * 3/2016

(Continued)

OTHER PUBLICATIONS

Machine translation of CN105401254A from Google patents, 8 pages. (Year: 2022).*

(Continued)

*Primary Examiner* — Emmanuel S Luk
(74) *Attorney, Agent, or Firm* — GREENBLUM & BERNSTEIN, P.L.C.

(57) ABSTRACT

A method for producing a polyacetal fiber that presents an improved whiteness unevenness is provided. According to one embodiment, there is provided a polyacetal fiber production method that yields a polyacetal fiber using an oxymethylene copolymer having a melt index, at 190° C. under a load of 2.16 kg, of 5-60 g/10 min, wherein the production method includes taking off the polyacetal fiber from the discharge nozzle of a spinning apparatus, and drawing the taken-off polyacetal fiber. The tensile elongation E1 of the polyacetal fiber after the taking off is 20%-500%; the tensile elongation E2 of the polyacetal fiber after the drawing is 10%-100%; E1≥E2; and the single fiber thickness of the polyacetal fiber after the drawing is 0.7-5.0 denier.

9 Claims, 1 Drawing Sheet

(56) References Cited

U.S. PATENT DOCUMENTS

| | | | | |
|---|---|---|---|---|
| 4,874,658 | A * | 10/1989 | Sasaki | B29C 70/16 428/910 |
| 4,980,957 | A * | 1/1991 | Sussman | B29C 55/00 264/290.5 |
| 5,968,432 | A * | 10/1999 | Kawai | D01D 5/12 264/211.16 |
| 2004/0175566 | A1 | 9/2004 | Kikutani et al. | |
| 2014/0178687 | A1* | 6/2014 | Gronner | A63B 51/02 428/401 |
| 2015/0225536 | A1 | 8/2015 | Ito | |
| 2018/0202077 | A1* | 7/2018 | Fujie | C08L 23/12 |

FOREIGN PATENT DOCUMENTS

| | | | |
|---|---|---|---|
| JP | 60-52618 | | 3/1985 |
| JP | 2001-049521 | A | 2/2001 |
| JP | 2001-172821 | | 6/2001 |
| JP | 2003-89925 | | 3/2003 |
| JP | 2005-256189 | | 9/2005 |
| JP | 2006-9196 | | 1/2006 |
| JP | 4907023 | | 3/2012 |
| JP | 2013-204176 | A | 10/2013 |
| JP | 2017-514023 | A | 6/2017 |
| WO | 2009/054593 | A1 | 4/2009 |
| WO | 2014/050448 | | 4/2014 |
| WO | 2015/068192 | A1 | 5/2015 |
| WO | 2015/076911 | A2 | 5/2015 |
| WO | 2015-154971 | A1 | 10/2015 |

OTHER PUBLICATIONS

Machine translation of JP2005256189A from Google patents, 6 pages. (Year: 2022).*

Machine translation of JP2006009196A from Google patents, 7 pages. (Year: 2022).*

Office Action issued in corresponding Japanese Patent Application No. 2019-528993 dated Oct. 19. 2021, along with English Translation thereof.

International Search Report issued in International BU Patent Application No. PCT/JP2018/021957, dated Aug. 14, 2018.

Decision of Refusal issued in the corresponding Japanese Patent Application No. 2019-528993 dated May 17, 2022, along with English translation thereof.

* cited by examiner

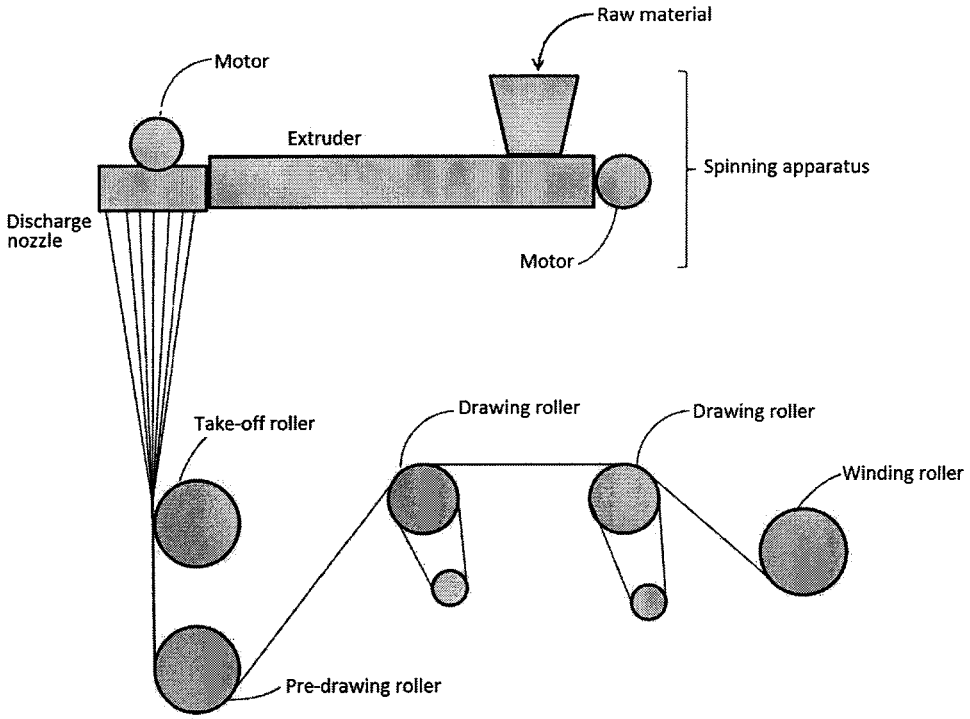
Raw material
Motor
Extruder
Spinning apparatus
Discharge nozzle
Motor
Take-off roller
Drawing roller
Drawing roller
Winding roller
Pre-drawing roller

METHOD FOR PRODUCING POLYACETAL FIBER

TECHNICAL FIELD

The present invention relates to a method for producing a polyacetal fiber.

BACKGROUND ART

A polyacetal is a polymer having a polymer skeleton mainly composed of the repeat of an oxymethylene unit, and because of its characteristics including mechanical strength, chemical resistance and solvent resistance, it is used mainly as a material for injection molding in a wide range of fields including automobiles and electric appliances.

As methods for producing a polyacetal fiber, a method for producing a fiber having high strength and high elastic modulus (Patent Document 1), a method for producing a high-strength fiber having heat resistance, abrasion resistance and chemical resistance (Patent Document 2), etc. have been disclosed.

PRIOR ART DOCUMENTS

Patent Documents

Patent Document 1: Japanese Patent No. 4907023

Patent Document 2: Japanese Laid-Open Patent Publication No. 2001-172821

SUMMARY OF THE INVENTION

Problems to be Solved by the Invention

Though the polyacetal is a resin material having excellent physical properties as described above, when it is spun as a fiber according to a conventional method, the color of a polyacetal fiber obtained may be whitish. When the color of the fiber has such unevenness, problems may occur, for example, thickness unevenness of the fiber may be increased, or workability may be unstable at the time of subsequent false twisting and weaving/knitting.

The present inventors found out that whiteness unevenness tends to be caused more in the polyacetal fiber when compared to general resin fibers such as polyester fibers. Accordingly, the purpose of the present invention is to provide a method for producing a polyacetal fiber, wherein whiteness unevenness is improved.

Means for Solving the Problems

The present inventors diligently made researches in order to solve the above-described problem and found that the above-described problem can be solved by a production method in which the tensile elongation rate of the polyacetal fiber after the take-off step, the tensile elongation rate of the polyacetal fiber after the drawing step, etc. are adjusted within predetermined ranges, and thus the present invention was achieved.

The present invention is, for example, as described below.

[1] A method for producing a polyacetal fiber, wherein the polyacetal fiber is obtained by using an oxymethylene copolymer having a melt index of 5 to 60 g/10 min at 190° C. under a load of 2.16 kg, the method comprising:

a take-off step for taking off the polyacetal fiber from a discharge nozzle of a spinning apparatus; and a drawing step for drawing the taken-off polyacetal fiber, wherein:

the tensile elongation rate E1 of the polyacetal fiber after the take-off step is 20 to 500%, and the tensile elongation rate E2 of the polyacetal fiber after the drawing step is 10 to 100%;

E1≥E2; and the single fiber thickness of the polyacetal fiber after the drawing step is 0.7 to 5.0 denier.

[2] The method according to item [1], wherein the half crystallization time of the oxymethylene copolymer is 5 to 500 sec.

[3] The method according to item [1] or [2], wherein the oxymethylene copolymer has an oxymethylene unit and an oxyethylene unit, and wherein the content of the oxyethylene unit is 0.5 to 7.0 mol relative to 100 mol of the oxymethylene unit.

[4] The method according to any one of items [1] to [3], wherein the draw ratio in the drawing step satisfies formula (A) below:

$$110 \leq (100+E1)/\text{Draw ratio} \leq 200 \quad (A)$$

[5] The method according to any one of items [1] to [4], wherein:

in the drawing step, drawing is carried out in two stages using a pre-drawing roller and two or more drawing rollers; and the tensile elongation rate E3 of the polyacetal fiber after the first-stage drawing of the drawing step is 10 to 150% and E1≥E3≥E2.

[6] The method according to any one of items [1] to [5], wherein:

the drawing step is carried out using a pre-drawing roller and two or more drawing rollers; and in the drawing step, the polyacetal fiber is passed through the pre-drawing roller and then the two or more drawing rollers, and the temperature of at least one of the two or more drawing rollers is 3 to 20° C. higher than the temperature of the pre-drawing roller.

[7] The method according to item [6], wherein in the drawing step, the temperature of the pre-drawing roller and the temperature of at least one of the two or more drawing rollers are 130 to 155° C.

[8] The method according to any one of items [1] to [7], wherein the fineness unevenness (U %) of the polyacetal fiber after the drawing step is 0.5 to 9%.

[9] The method according to any one of items [1] to [8], wherein the tensile elongation E2 of the polyacetal fiber is 10 to 50%.

Advantageous Effect of the Invention

According to the present invention, it is possible to provide a method for producing a polyacetal fiber in which the whiteness unevenness is improved.

BRIEF DESCRIPTION OF THE DRAWINGS

FIG. 1 is a schematic view of an apparatus for producing a polyacetal fiber.

DESCRIPTION OF EMBODIMENTS

Hereinafter, the present invention will be described in detail by way of production examples, working examples, etc., but the present invention is not limited thereto and can be arbitrarily changed and then practiced within a range not departing from the gist of the present invention.

<Method for Producing Polyacetal Fiber>

The method for producing a polyacetal fiber of the present invention is a method for obtaining a polyacetal fiber by using an oxymethylene copolymer having a melt index of 5 to 60 g/10 min at 190° C. under a load of 2.16 kg. This production method is characterized in that it comprises: a take-off step for taking off the polyacetal fiber from a discharge nozzle of a spinning apparatus; and a drawing step for drawing the taken-off polyacetal fiber, wherein: the tensile elongation rate E1 of the polyacetal fiber after the take-off step is 20 to 500%, and the tensile elongation rate E2 of the polyacetal fiber after the drawing step is 10 to 100%; E1≥E2; and the single fiber thickness of the polyacetal fiber after the drawing step is 0.7 to 5 denier.

As described above, the present inventors found that whiteness unevenness is improved by the production method in which the tensile elongation rate of the polyacetal fiber after the take-off step, the tensile elongation rate of the polyacetal fiber after the drawing step and the like are adjusted within predetermined ranges. Moreover, the present inventors found that transparency, spinnability (processing stability at the time of spinning) and secondary workability of a fiber obtained are also improved in addition to whiteness unevenness by employing the production method in which the type of polyacetal to be used as a raw material, the single fiber thickness of the polyacetal fiber after the drawing step and the like are adjusted within predetermined ranges. It was also found that transparency, spinnability and secondary workability are further improved by carrying out the drawing step in two stages at the time of spinning and by suitably setting the temperature of drawing rollers.

One embodiment of the method for producing the polyacetal fiber of the present invention will be described using the schematic view of FIG. 1. In one embodiment of the present invention, the polyacetal fiber is produced by taking off a plurality of fibrous materials (filaments) discharged from a discharge nozzle of a spinning apparatus using a take-off roller to make a fiber, followed by drawing it using a pre-drawing roller and drawing rollers. According to need, after the drawing step, the drawn fiber may be wound with a winding roller. Further, the take-off step and the drawing step are preferably carried out continuously. Note that the method for producing the polyacetal fiber of the present invention can be applied not only to a multifilament spinning method like that of FIG. 1, but also to a monofilament spinning method.

The constitution of the spinning apparatus to be used for the production method of the present invention is not particularly limited, and it is sufficient when it can melt the oxymethylene copolymer as the raw material and can discharge the polyacetal fiber from the discharge nozzle. According to need, the spinning apparatus may have an extruder or the like to melt-knead the oxymethylene copolymer as the raw material in the spinning apparatus. Examples of the spinning apparatus include general multifilament or monofilament melt spinning apparatuses configured with a single screw extruder, a gear pump, a screen and a die. Further, the cylinder temperature of the extruder, the temperature of the gear pump, the number of holes of the discharge nozzle, etc. can be suitably adjusted according to need. Moreover, the fineness (fiber thickness) of the fiber after drawing can be suitably adjusted by the feed amount of the raw material and the speed of the winding roller.

The filaments discharged from the discharge nozzle of the spinning apparatus are firstly taken off by the take-off roller as the polyacetal fiber, then sent to the pre-drawing roller, and then drawn by using at least one drawing roller. By performing drawing, the tensile strength of the fiber can be improved. As used herein, the "pre-drawing roller" refers to a roller arranged between the drawing roller and the take-off roller, and usually, between the pre-drawing roller and the take-off roller, the fiber is not drawn or slightly drawn for the purpose of ensuring spinning stability. Further, the "drawing roller" refers to a roller arranged after the pre-drawing roller, and the fiber is drawn between the pre-drawing roller and the drawing roller and/or between a plurality of drawing rollers. In the method for producing the polyacetal fiber of the present invention, at least one drawing roller is used, and preferably, two or more drawing rollers are used. It is preferred to use two or more drawing rollers because the polyacetal fiber can be drawn in a plurality of stages.

By adjusting the take-off rate (m/min) of the take-off roller and the winding rate (m/min) of the winding roller, the tensile elongation rate E1 of the polyacetal fiber after the take-off step and the tensile elongation rate E2 of the polyacetal fiber after the drawing step can be adjusted. The tensile elongation rate E1 of the polyacetal fiber after the take-off step is 20 to 500%, preferably 50 to 400%, and more preferably 100 to 300%; the tensile elongation rate E2 of the polyacetal fiber after the drawing step is 10 to 100%, preferably 10 to 50%, and more preferably 10 to 40%; and E1≥E2. The tensile elongation rate E1 of the polyacetal fiber after the take-off step and the tensile elongation rate E2 of the polyacetal fiber after the drawing step can be measured, for example, by using a measurement device such as Autograph AGS-X-1 kN manufactured by Shimadzu Corporation, wherein the fiber is fixed to a fixture in which the distance between chucks is 120 mm and drawn at a rate of 100 m/min.

The take-off rate (m/min) of the take-off roller and the winding rate (m/min) of the winding roller are not particularly limited as long as the above-described E1 and E2 can be satisfied thereby, but for example, the take-off rate (m/min) of the take-off roller and the pre-drawing roller are preferably 300 to 6000 m/min, and particularly preferably 400 to 3000 m/min. The drawing roller and the winding rate (m/min) of the winding roller are preferably 1000 to 6000 m/min, and particularly preferably 2000 to 6000 m/min. It is preferred that the rotation rate of the pre-drawing roller is almost equal to the take-off rate of the take-off roller. There is no problem when the winding rate of the winding roller is almost equal to the rotation rate of the drawing roller, but in consideration of shrinkage of the polyacetal fiber, it is preferred that the winding rate is 0.1 to 10%, preferably 0.3 to 5%, and more preferably 0.5 to 2% lower than the rotation rate of the drawing roller. A value obtained by dividing the speed difference between the pre-drawing roller and the drawing roller by the distance between the rollers is defined as a strain rate. The strain rate is one of parameters expressing drawing conditions, and when it is too high, it causes drawing breakage. For this reason, the strain rate is preferably 0 to 10000 (1/min), more preferably 2000 to 10000 (1/min), and even more preferably 5000 to 9000 (1/min).

The draw ratio in the drawing step is not particularly limited as long as the problem of the present invention can be solved thereby, but it preferably satisfies formula (A) below:

$$110 \leq (100+E1)/\text{Draw ratio} \leq 200 \quad \text{(A)}$$

The above-described formula (A) defines that the tensile elongation rate of the finished fiber is adjusted to be 10 to 100% by providing multiplication by the draw ratio depending on the elongation rate at the time of taking off, and it is derived from formula (B) below:

$$10 \leq [\{(100+E1)-(100\times\text{Draw ratio})\}/(100\times\text{Draw ratio})]\times 100 \leq 100 \quad \text{(B)}$$

According to another preferred embodiment of the present invention, the draw ratio in the drawing step satisfies formula (C) below:

$$110 \leq (100+E1)/\text{Draw ratio} \leq 150 \quad \text{(C)}$$

As used herein, the "draw ratio" refers to a value indicating how much the fiber before drawing is elongated in the drawing step, and it can be calculated by dividing the rotation rate of the drawing roller by the rotation rate of the pre-drawing roller.

According to a preferred embodiment of the present invention, drawing can be carried out in a multistage manner in the drawing step using the pre-drawing roller and two or more drawing rollers. By performing drawing in a multistage manner, spinning stability and secondary workability can be further improved. When performing drawing in a multistage manner, E2 represents a tensile elongation rate of the polyacetal fiber after all the stages of the drawing step. According to a more preferred embodiment of the present invention, drawing can be carried out in two stages in the drawing step using the pre-drawing roller and the two or more drawing rollers. When performing drawing in two stages, it is preferred that: the tensile elongation rate E1 of the polyacetal fiber after the take-off step is 20 to 500%, preferably 50 to 400%, and more preferably 100 to 300%; the tensile elongation rate E3 of the polyacetal fiber after the first-stage drawing of the drawing step is 10 to 150%, preferably 20 to 140%, and more preferably 30 to 120%; the tensile elongation rate E2 of the polyacetal fiber after all the stages of the drawing step is 10 to 100%, preferably 10 to 50%, and more preferably 10 to 40%; and $E1 \geq E3 \geq E2$. By performing drawing in a multistage manner as described above, it is possible to obtain a polyacetal fiber which is excellent with respect to whiteness unevenness and is also more excellent in spinnability and secondary workability.

According to a preferred embodiment of the present invention, the drawing step is carried out using a pre-drawing roller and two or more drawing rollers, and in the drawing step, the polyacetal fiber is passed through the pre-drawing roller and then the two or more drawing rollers, and the temperature of at least one of the two or more drawing rollers is 3 to 20° C., and preferably 5 to 20° C. higher than the temperature of the pre-drawing roller. In the constitution in which the drawing step is carried out using the pre-drawing roller and the two or more drawing rollers, wherein the polyacetal fiber is passed through the pre-drawing roller and then the two or more drawing rollers, by adjusting the temperatures of the pre-drawing roller and drawing rollers, spinning stability is improved. According to a more preferred embodiment of the present invention, in the drawing step, the temperature of the pre-drawing roller and the temperature of at least one of the two or more drawing rollers are 130 to 155° C. By adjusting the temperatures of the pre-drawing roller and drawing rollers as described above, it is possible to obtain a polyacetal fiber having good spinnability.

The single fiber thickness of the polyacetal fiber after the drawing step is 0.7 to 5.0 denier, preferably 1.0 to 4.0 denier, and more preferably 1.2 to 3.0 denier. The single fiber thickness is defined by a value obtained by dividing the fineness (fiber thickness) of the fiber after drawing (one multifilament) by the number of holes of the discharge nozzle of the spinning apparatus. When the single fiber thickness is within the range of from 0.7 to 5.0 denier, it is possible to obtain a polyacetal fiber having excellent spinnability and secondary workability, wherein drawing breakage at the time of spinning does not easily occur.

<Polyacetal Fiber>

The polyacetal fiber of the present invention is a polymer fiber having an oxymethylene structure as a unit structure and can be obtained by spinning an oxymethylene copolymer according to the production method of the present invention. The polyacetal fiber of the present invention is excellent with respect to whiteness unevenness, and the entire fiber has uniform and transparent whiteness. In a preferred embodiment of the present invention, the polyacetal fiber of the present invention is also excellent in spinnability and secondary workability. As used herein, "spinnability" refers to an index which indicates whether or not the fiber can be stably obtained (the fiber is not broken during spinning and the operation is not stopped), and "secondary workability" refers to an index for evaluating the stability in the case of further processing (e.g., drawing or staining) the fiber after drawing by means of the variation in the measurement value at the time of measuring the tensile elongation rate. The criteria of the respective indexes will be specifically described in the Examples.

In a preferred embodiment of the present invention, the fineness unevenness (U %) of the polyacetal fiber after the drawing step is 0.5 to 9.0%, more preferably 0.5 to 8.0, and particularly preferably 0.6 to 5.0. As used herein, the "fineness unevenness (U %)" refers to a percentage of an average unevenness deviation, and for example, it can be measured in accordance with 9.20 of JIS L 1095:2016 using a measurement device such as USTER TESTER 5 manufactured by USTER. Further, in another preferred embodiment of the present invention, the draw ratio of the polyacetal fiber is 0.5 to 5.0 times, more preferably 1.0 to 4.0 times, and even more preferably 1.2 to 3.0 times.

The oxymethylene copolymer to be used in the production method of the present invention is not particularly limited as long as it has a melt index of 5 to 60 g/10 min at 190° C. under a load of 2.16 kg. The oxymethylene copolymer has a melt index under the same conditions of preferably 5 to 50 g/10 min, and more preferably 7 to 40 g/10 min. The melt index can be measured, for example, in accordance with ISO 1133 using a melt indexer manufactured by Toyo Seiki Co., Ltd. or the like.

In a preferred embodiment of the present invention, the half crystallization time of the oxymethylene copolymer is 5 to 500 sec, more preferably 10 to 300 sec, and even more preferably 15 to 100 sec. As used herein, the half crystallization time of the oxymethylene copolymer refers to a time required for crystallization in the case of isothermal holding at 150° C., and it can be measured, for example, in accordance with JIS K 7121:2012 using a measurement device such as Diamond DSC manufactured by Perkin Elmer.

As the oxymethylene copolymer, one oxymethylene copolymer may be used solely, or a plurality of oxymethylene copolymers, in which the types and contents of comonomers differ from each other, may be used as a mixture. Other than the oxymethylene unit, the oxymethylene copolymer has an oxyalkylene unit represented by formula (1) below in the molecule:

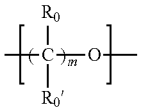

(1)

where, $R_0$ and $R_0'$ may be the same or different and are a hydrogen atom, an alkyl group, a phenyl group or an alkyl group interrupted by at least one ether bond; and m is an integer of 2 to 6.

The alkyl group is a substituted or unsubstituted and linear or branched alkyl group having 1 to 20 carbon atoms, and it is preferably a linear or branched alkyl group having 1 to 4 carbon atoms. Examples of the alkyl group include methyl, ethyl, n-propyl, i-propyl, n-butyl, i-butyl, t-butyl, pentyl, hexyl, decyl, dodecyl and octadecyl.

Examples of substituents include a hydroxy group, an amino group, an alkoxy group, an alkenyloxymethyl group and halogen. In this regard, examples of the alkoxy group include methoxy, ethoxy and propoxy. Further, examples of the alkenyloxymethyl group include allyloxymethyl.

The phenyl group is an unsubstituted phenyl group, or a phenyl group substituted with substituted or unsubstituted alkyl group, a substituted or unsubstituted aryl group or halogen. In this regard, examples of the aryl group include phenyl, naphthyl and anthracyl.

Examples of the alkyl group interrupted by at least one ether bond include a group represented by formula (2) below:

$$—CH_2—O—(R_1—O)_p—R_2 \quad (2)$$

where $R_1$ is an alkylene group; p represents an integer of 0 to 20; $R_2$ is a hydrogen atom, an alkyl group, a phenyl group or a glycidyl group; and ($R_1$—O) units may be the same or different.

The alkylene group is a linear or branched and substituted or unsubstituted alkylene group having 2 to 20 carbon atoms, and examples thereof include ethylene, propylene, butylene and 2-ethylhexylene. The alkylene as $R_1$ is preferably ethylene or propylene.

It is preferred that $R_0$ and $R_0'$ are the same and are a hydrogen atom.

Examples of the oxyalkylene unit represented by formula (1) include an oxyethylene unit, an oxypropylene unit, an oxybutylene unit, an oxypentylene unit and an oxyhexylene unit. Preferred are an oxyethylene unit, an oxypropylene unit and an oxybutylene unit, and more preferred is an oxyethylene unit.

The oxymethylene copolymer can further have a unit represented by formula (3) below:

$$—CH(CH_3)—CHR_3— \quad (3)$$

where $R_3$ is a group represented by formula (4) below:

$$—O—(R_1—O)_p—R_4 \quad (4)$$

where $R_4$ is a hydrogen atom, an alkyl group, an alkenyl group, a phenyl group or a phenylalkyl group; and $R_1$ and p are as defined with respect to formula (2).

The alkenyl group is a linear or branched and substituted or unsubstituted alkenyl group having 2 to 20 carbon atoms, and examples thereof include vinyl, allyl and 3-butenyl.

Examples of the alkyl moiety and the phenyl moiety in the phenylalkyl group include those mentioned with respect to the alkyl group and the phenyl group above. Examples of the phenylalkyl group include benzyl, phenylethyl, phenylbutyl, 2-methoxybenzyl, 4-methoxybenzyl and 4-(allyloxymethyl) benzyl.

In the present invention, when a crosslinking structure exists, the alkenyl group and the glycidyl group in the group represented by formula (2) or the alkenyl group in the group represented by formula (4) can be a crosslinking point in a further polymerization reaction, and the crosslinking structure is formed thereby.

The method for producing the oxymethylene copolymer is not particularly limited, and examples thereof include a method in which trioxane that is a trimer of formaldehyde and a comonomer are subjected to a bulk polymerization using a cationic polymerization catalyst such as boron trifluoride, perchloric acid and heteropolyacid. Examples of the comonomer include: a cyclic ether having 2 to 8 carbon atoms such as ethylene oxide, 1,3-dioxolane, 1,3,5-trioxepane and 1,3,6-trioxocan; and a cyclic formal having 2 to 8 carbon atoms such as a cyclic formal of glycol and a cyclic formal of diglycol. By these comonomers, the oxyalkylene unit represented by formula (1), wherein $R_0$ and $R_0'$ are the same and are a hydrogen atom, is formed.

In the present invention, the oxymethylene copolymer includes a binary copolymer and a multi-component copolymer. Accordingly, as the oxymethylene copolymer to be used in the production method of the present invention, an oxymethylene copolymer which has the oxymethylene unit and the oxyalkylene unit represented by formula (1), an oxymethylene copolymer which includes the oxymethylene unit, the oxyalkylene unit represented by formula (1) and the unit represented by formula (3), an oxymethylene copolymer which further has a crosslinking structure, etc. can be widely used. In the present invention, the unit represented by formula (1), wherein not both of $R_0$ and $R_0'$ are a hydrogen atom, can be formed, for example, by copolymerizing a glycidyl ether compound and/or an epoxy compound, and the unit represented by formula (3) can be formed, for example, by copolymerizing an allyl ether compound.

The glycidyl ether and epoxy compounds are not particularly limited, and examples thereof include: epichlorohydrin; alkyl glycidyl formals such as methyl glycidyl formal, ethyl glycidyl formal, propyl glycidyl formal and butyl glycidyl formal; diglycidyl ethers such as ethylene glycol diglycidyl ether, propylene glycol diglycidyl ether, 1,4-butanediol diglycidyl ether, hexamethylene glycol diglycidyl ether, resorcinol diglycidyl ether, bisphenol A diglycidyl ether, hydroquinone diglycidyl ether, polyethylene glycol diglycidyl ether, polypropylene glycol diglycidyl ether and polybutylene glycol diglycidyl ether; triglycidyl ethers such as glycerin triglycidyl ether and trimethylolpropane triglycidyl ether; and tetraglycidyl ethers such as pentaerythritol tetraglycidyl ether.

Examples of the allyl ether compound include polyethylene glycol allyl ether, methoxypolyethylene glycol allyl ether, polyethylene glycol-polypropylene glycol allyl ether, polypropylene glycol allyl ether, butoxypolyethylene glycol-polypropylene glycol allyl ether, polypropylene glycol diallyl ether, phenylethyl allyl ether, phenylbutyl allyl ether, 4-methoxybenzyl allyl ether, 2-methoxybenzyl allyl ether and 1,4-diallyloxymethylbenzene.

In a preferred embodiment of the present invention, the oxymethylene copolymer has an oxymethylene unit and an oxyethylene unit (included in the oxyalkylene unit represented by formula (1)), wherein the content of the oxyethylene unit is 0.5 to 7.0 mol, more preferably 1.0 to 4.0 mol, and even more preferably 1.0 to 2.5 mol relative to 100 mol of the oxymethylene unit. The content of the oxymethylene unit and the oxyethylene unit in the oxymethylene copolymer can be measured according to the nuclear magnetic resonance (NMR) method.

Examples of chain transfer agents include carboxylic acid, carboxylic anhydride, ester, amide, imide, phenols and an acetal compound. Among them, preferred are phenol, 2,6-dimethylphenol, methylal and polyacetal dimethoxide, and more preferred is methylal. Examples of solvents include: aliphatic hydrocarbons such as hexane, heptane and cyclohexane; aromatic hydrocarbons such as benzene, toluene and xylene; and halogenated hydrocarbons such as methylene dichloride and ethylene dichloride. The chain transfer agent can be used solely or in the form of a solution in which the chain transfer agent is dissolved in the solvent. When the chain transfer agent is methylal, usually, the adding amount thereof can be less than $2\times10^{-1}$ wt % relative to trioxane.

Examples of commercially-available products of the oxymethylene copolymer include "Iupital (registered trademark), F20-03" and "Iupital (registered trademark), F40-03" (manufactured by Mitsubishi Engineering-Plastics Corporation).

To the oxymethylene copolymer, a publicly-known additive and/or filler can be added within a range in which the purpose of the present invention is not impaired. Examples of the additive include a crystal nucleating agent, an antioxidant, a plasticizer, a matting agent, a foaming agent, a lubricant, a mold release agent, an antistatic agent, an ultraviolet absorber, a light stabilizer, a heat stabilizer, a deodorizer, a flame retardant, a sliding agent, a perfume and an antimicrobial agent. Further, examples of the filler include glass fiber, talc, mica, calcium carbonate and potassium titanate whiskers. In addition, it is also possible to add a pigment or dye thereto to obtain a finished product having a desired color. It is also possible to add a transesterification catalyst, various monomers, a coupling agent (e.g., another polyfunctional isocyanate compound, an epoxy compound, a glycidyl compound, diaryl carbonates, etc.), an end treatment agent, other resins, wood flour and a naturally-occurring organic filler such as starch for modification. The timing of adding the above-described additive, filler, etc. is not limited. These materials may be added at the stage of obtaining the oxymethylene copolymer to carry out the production. Alternatively, these materials may be put into an extruder together with the oxymethylene copolymer at the time of the production of the polyacetal fiber.

The polyacetal fiber obtained by the production method of the present invention comprises a plurality of filaments. Specifically, the polyacetal fiber is obtained by bundling a plurality of filaments discharged from a plurality of discharge nozzles.

EXAMPLES

Hereinafter, the effects of the embodiments will be described by way of working examples and comparative examples. Note that the technical scope of the present invention is not limited thereto.

<Measurement Methods and Evaluation Methods>

The measurement and the evaluation of respective physical properties with respect to working examples and comparative examples in this specification were carried out according to methods described below.

1. Melt Index (Hereinafter Referred to as "MI")

As a measurement device, a melt indexer manufactured by Toyo Seiki Co., Ltd. was used. The measurement was carried out in accordance with ISO 1133 at 190° C. under a load of 2.16 kg.

2. Tensile Elongation Rates of Polyacetal Fiber

The tensile elongation rate E1 of the polyacetal fiber after the take-off step, the tensile elongation rate E2 of the polyacetal fiber after the drawing step and the tensile elongation rate E3 of the polyacetal fiber after the first-stage drawing of the drawing step were respectively measured using Autograph AGS-X-1 kN manufactured by Shimadzu Corporation. At the time of the measurement, the polyacetal fiber was fixed to a fixture in which the distance between chucks is 120 mm and drawn at a rate of 100 m/min, thereby carrying out the measurement.

3. Whiteness Unevenness

The bobbin to which the polyacetal fiber was wound after drawing was visually observed, and it was judged whether or not the polyacetal fiber has whiteness unevenness. In the case of a polyacetal fiber uniformly drawn, the entire fiber has uniform whiteness, whereas in the case of a polyacetal fiber non-uniformly drawn, since insufficiently-drawn portions remain in the fiber, whiteness unevenness is recognized at the time of visual observation. Note that a uniformly drawn fiber is referred to as "one point drawing" and a non-uniformly drawn fiber is referred to as "multipoint drawing".

A: a fiber did not have unevenness (one point drawing)

D: a fiber had unevenness (multipoint drawing)

4. Transparency

The bobbin to which the polyacetal fiber was wound after drawing was visually observed, and it was judged whether or not the polyacetal fiber has transparency. The polyacetal fiber drawn under appropriate conditions does not have whiteness unevenness, and in addition, the entire fiber has uniform and transparent whiteness.

A: an entire fiber has uniform transparency

B: an entire fiber does not have uniform transparency

5. Spinnability

It indicates whether or not the fiber can be stably obtained (the fiber is not broken during spinning and the operation is not stopped).

A: significantly stable (a fiber was not broken during a time period of 3 hours or more)

B: stable (a fiber was not broken during a time period of 1 hour or more and was broken in less than 3 hours)

C: slightly unstable but it was within an acceptable range (a fiber was not broken during a time period of 15 minutes or more and was broken in less than 1 hour)

D: unstable (a fiber was broken in less than 15 minutes)

6. Secondary Workability

The stability in the case of further processing (drawing/staining) the fiber after drawing was evaluated by means of the variation in the measurement value at the time of measuring the tensile elongation rate.

A: significantly stable (the variation in the measurement of the elongation rate (n=5) was average±10% or less)

B: stable (the variation was average±more than 10% but 20% or less)

C: slightly unstable but it was within an acceptable range (the variation was average±more than 20% but 30% or less)

D: unstable (the variation was average±more than 30%)

7. Fineness Unevenness (U %)

The measurement was carried out using USTER TESTER 5 manufactured by USTER. The lower the value of fineness unevenness is, the better it is.

$$U\,\% = (\text{standard deviation of mass per 1 cm/average mass}) \times (2/3.14)^{(1/2)}$$

Measurement temperature: 22° C.

Measurement speed: 100 m/min

Measurement time: 10 min

Number of times of repeated measurement: 100,000 times

8. Half Crystallization Time

The obtained fiber was heated from 30° C. to 210° C. at a rate of 320° C./min using DSC (differential scanning calorimetry), then cooled to 150° C. at a rate of 80° C./min, then kept for 15 minutes, and the half crystallization time was obtained.

When the half crystallization time is too short, the resin is immediately solidified at an area near the discharge nozzle of the spinning apparatus, and thread breakage is caused and physical properties become unstable in the take-off step. Meanwhile, when the half crystallization time is too long, solidification does not proceed sufficiently during the take-off step and the thread tension is low, and this causes thread breakage (deterioration of spinnability).

The method for producing the polyacetal fiber related to working examples and comparative examples will be described below.

Example 1

(1) Preparation of Oxymethylene Copolymer

The oxymethylene copolymer that is the raw material of the polyacetal fiber related to working examples and comparative examples was prepared by the method described below. Firstly, 100 parts by mass of trioxane was mixed with 4.0 parts by mass of 1,3-dioxolane as a comonomer, boron trifluoride diethyl etherate as a catalyst was supplied thereto in an amount of 0.045 mmol per 1 mol of trioxane, and the mixture was polymerized in a twin screw kneader having paddles engaged with each other. At this time, methylal as a viscosity modifier was added in an amount of 0.12 parts by mass relative to 100 parts by mass of trioxane to adjust the viscosity. After the polymerization was completed, the catalyst was deactivated using a small amount of a benzene solution of triphenyl phosphine, and then crushing was carried out, thereby obtaining a crude oxymethylene copolymer.

Subsequently, to the crude oxymethylene copolymer, appropriate additives such as Irganox 245, melamine and PEG 20000 were added and blended, then the mixture was introduced into a co-rotating twin screw extruder (manufactured by The Japan Steel Works, Ltd., inner diameter: 69 mm, L/D=31.5) at a rate of 60 kg/hour, and the polyacetal polymer was melted in a vent part under a reduced pressure of 20 kPa at 220° C. and continuously introduced into a twin screw surface-renewal type horizontal kneader (60 L of the effective inner volume: the volume obtained by subtracting the volume occupied by stirring blades from the total inner volume). The liquid surface control was carried out so that the residence time in the twin screw surface-renewal type horizontal kneader became 25 minutes, and devolatilization was carried out under a reduced pressure of 20 kPa at 220° C. while the material was continuously extracted using a gear pump for palletization, thereby obtaining the oxymethylene copolymer as the raw material. The content of the oxyethylene unit relative to 100 mol of the oxymethylene unit in the oxymethylene copolymer was measured using an NMR apparatus (AVANCE 111500 manufactured by BRUKER). Further, the half crystallization time of the oxymethylene copolymer was 28 seconds.

(2) Spinning Conditions

The oxymethylene copolymer thus obtained was spun using a spinning apparatus equipped with an extruder with its cylinder temperature being set at 190° C., a gear pump and a discharge nozzle (manufactured by UNIPLAS). The discharge amount (feed amount) was 1 kg/h·Line, the number of holes of the discharge nozzle was 36, the take-off rate was 350 m/min, the rate of the pre-drawing roller was 350 m/min, the rate of the drawing roller was 1100 m/min, the winding rate was 1100 m/min, the temperature of the pre-drawing roller was 145° C., and the temperature of the drawing roller was 150° C.

At this time, the draw ratio was 3.1 times and the strain rate was 1500 (1/min).

(3) Physical Properties of Obtained Fiber

The physical properties of the obtained fiber were measured as described above. The tensile elongation rate E1 of the fiber after taking off was 500%, the tensile elongation rate E2 of the fiber after drawing was 91%, and the single fiber thickness of the polyacetal fiber after the drawing step was 3.8 denier. The fiber had no whiteness unevenness and was one point drawing. The spinnability and secondary workability were slightly unstable but within an acceptable range.

Examples 2-24 and Comparative Examples 1-4

The spinning conditions (feed amount, take-off rate, rate of the pre-drawing roller, rate of the drawing roller, winding rate and number of holes of the discharge nozzle) were changed from those of Example 1 as described in Tables 1-2, and each polyacetal fiber was spun. In particular, in Example 15, the tensile elongation rate E1 of the fiber after taking off was 250%, the tensile elongation rate E2 of the fiber after drawing was 17%, the single fiber thickness of the polyacetal fiber after the drawing step was 1.4 denier, and U % was 0.6%. In addition, the fiber had no whiteness unevenness, was one point drawing, had transparency, and was also excellent in spinnability and secondary workability. In Comparative Examples 3 and 4, when the number of holes of the discharge nozzle was increased in order to decrease the single fiber thickness, the fiber was not able to bear the tension at the time of spinning and thread breakage frequently occurred, resulting in inferior spinnability. The evaluation results are shown in Tables 1-2. The parenthesized values with respect to the fineness unevenness are values in the case where the significant figures are two-digit numbers.

TABLE 1

| Physical properties or production conditions | Unit | Examples 1 | 2 | 3 | 4 | 5 | 6 | 7 |
|---|---|---|---|---|---|---|---|---|
| Content of oxyethylene unit relative to 100 mol of oxymethylene unit | mol | 1.5 | 1.5 | 1.5 | 1.5 | 1.5 | 1.5 | 1.5 |
| MI | g/10 min | 27 | 27 | 27 | 27 | 27 | 27 | 27 |
| Half crystallization time | sec | | | | 28 | | | |
| Feed amount | kg/h · Line | 1 | 1 | 1 | 1 | 1 | 1 | 1 |
| Take-off rate | m/min | 350 | 340 | 340 | 420 | 590 | 790 | 990 |
| Tensile elongation rate E1 of fiber after taking off | % | 500 | 500 | 500 | 450 | 350 | 270 | 210 |

TABLE 1-continued

| | | | | | | | | |
|---|---|---|---|---|---|---|---|---|
| Rate of pre-drawing roller | m/min | 350 | 350 | 350 | 430 | 600 | 800 | 1000 |
| Rate of drawing roller | m/min | 1100 | 1300 | 1530 | 2000 | 2200 | 2400 | 2600 |
| Strain rate | 1/min | 1500 | 1900 | 2360 | 3140 | 3200 | 3200 | 3200 |
| Draw ratio | times | 3.1 | 3.7 | 4.4 | 4.7 | 3.7 | 3.0 | 2.6 |
| Tensile elongation rate E2 of fiber after drawing | % | 91 | 62 | 37 | 18 | 23 | 23 | 19 |
| Winding rate | m/min | 1100 | 1300 | 1500 | 2000 | 2200 | 2400 | 2600 |
| Number of holes of discharge nozzle | number | 36 | 36 | 36 | 36 | 36 | 36 | 36 |
| Single fiber thickness after drawing step | denier | 3.8 | 3.2 | 2.8 | 2.1 | 1.9 | 1.7 | 1.6 |
| (100 + E1)/Draw ratio | — | 191 | 162 | 137 | 118 | 123 | 123 | 119 |
| Evaluation results | | | | | | | | |
| Whiteness unevenness | — | A | A | A | A | A | A | A |
| Transparency | — | B | B | B | B | B | B | A |
| Spinnability | — | C | B | B | B | B | A | A |
| Secondary workability | — | C | C | B | B | A | A | A |
| Fineness unevenness (U %) | % | | | 4 (3.7) | 2 (2.0) | | | 1 (0.9) |

| Physical properties or production conditions | Unit | Examples | | | | | | |
|---|---|---|---|---|---|---|---|---|
| | | 8 | 9 | 10 | 11 | 12 | 13 | 14 |
| Content of oxyethylene unit relative to 100 mol of oxymethylene unit | mol | 1.5 | 1.5 | 1.5 | 1.5 | 1.5 | 1.5 | 1.5 |
| MI | g/10 min | 27 | 27 | 27 | 27 | 27 | 27 | 27 |
| Half crystallization time | sec | | | | 28 | | | |
| Feed amount | kg/h · Line | 1 | 1 | 1 | 2 | 2 | 2 | 2 |
| Take-off rate | m/min | 1980 | 2970 | 4950 | 790 | 790 | 990 | 1980 |
| Tensile elongation rate E1 of fiber after taking off | % | 180 | 90 | 40 | 490 | 490 | 420 | 250 |
| Rate of pre-drawing roller | m/min | 2000 | 3000 | 5000 | 800 | 800 | 1000 | 2000 |
| Rate of drawing roller | m/min | 5050 | 5050 | 5550 | 3030 | 4040 | 4040 | 5250 |
| Strain rate | 1/min | 6100 | 4100 | 1100 | 4460 | 6480 | 6080 | 6500 |
| Draw ratio | times | 2.5 | 1.7 | 1.1 | 3.8 | 5.1 | 4.0 | 2.6 |
| Tensile elongation rate E2 of fiber after drawing | % | 11 | 13 | 26 | 56 | 17 | 29 | 33 |
| Winding rate | m/min | 5000 | 5000 | 5500 | 3000 | 4000 | 4000 | 5200 |
| Number of holes of discharge nozzle | number | 36 | 36 | 36 | 36 | 36 | 36 | 36 |
| Single fiber thickness after drawing step | denier | 0.8 | 0.8 | 0.8 | 2.8 | 2.1 | 2.1 | 1.6 |
| (100 + E1)/Draw ratio | — | 111 | 113 | 126 | 156 | 117 | 129 | 133 |
| Evaluation results | | | | | | | | |
| Whiteness unevenness | — | A | A | A | A | A | A | A |
| Transparency | — | A | B | B | B | A | B | A |
| Spinnability | — | A | B | B | B | C | B | A |
| Secondary workability | — | A | A | A | C | B | B | B |
| Fineness unevenness (U %) | % | | | 3 (2.7) | | | | 2 (1.7) |

TABLE 2

| Physical properties or production conditions | Unit | Examples | | | | | | |
|---|---|---|---|---|---|---|---|---|
| | | 15 | 16 | 17 | 18 | 19 | 20 | 21 |
| Content of oxyethylene unit relative to 100 mol of oxymethylene unit | mol | 1.5 | 1.5 | 1.5 | 1.5 | 1.5 | 1.5 | 1.5 |
| MI | g/10 min | 27 | 27 | 27 | 27 | 27 | 27 | 27 |
| Half crystallization time | sec | | | | 28 | | | |
| Feed amount | kg/h · Line | 2 | 2 | 2 | 2 | 4 | 4 | 4 |
| Take-off rate | m/min | 1980 | 2970 | 3960 | 4950 | 1980 | 3960 | 5950 |
| Tensile elongation rate E1 of fiber after taking off | % | 250 | 180 | 150 | 70 | 290 | 140 | 60 |
| Rate of pre-drawing roller | m/min | 2000 | 3000 | 4000 | 5000 | 2000 | 4000 | 6000 |
| Rate of drawing roller | m/min | 6000 | 6000 | 6000 | 6000 | 6000 | 6000 | 6000 |
| Strain rate | l/min | 8000 | 6000 | 4000 | 2000 | 8000 | 4000 | 0 |
| Draw ratio | times | 3.0 | 2.0 | 1.5 | 1.2 | 3.0 | 1.5 | 1.0 |
| Tensile elongation rate E2 of fiber after drawing | % | 17 | 40 | 67 | 42 | 30 | 60 | 60 |
| Winding rate | m/min | 5980 | 5980 | 5980 | 5980 | 5980 | 5980 | 5980 |
| Number of holes of discharge nozzle | number | 36 | 36 | 36 | 36 | 36 | 36 | 36 |
| Single fiber thickness after drawing step | denier | 1.4 | 1.4 | 1.4 | 1.4 | 2.8 | 2.8 | 2.8 |
| (100 + E1)/Draw ratio | — | 117 | 140 | 167 | 142 | 130 | 160 | 160 |

TABLE 2-continued

| Evaluation results | | | | | | | | |
|---|---|---|---|---|---|---|---|---|
| Whiteness unevenness | — | A | A | A | A | A | A | A |
| Transparency | — | A | A | B | B | B | B | B |
| Spinnability | — | A | A | B | B | A | A | B |
| Secondary workability | — | A | A | C | C | A | B | B |
| Fineness unevenness (U %) | % | 1 (0.6) | 1 (0.9) | 3 (2.5) | | 3 (2.6) | | |

| Physical properties or production conditions | Unit | Examples | | | Comparative Examples | | | |
|---|---|---|---|---|---|---|---|---|
| | | 22 | 23 | 24 | 1 | 2 | 3 | 4 |
| Content of oxyethylene unit relative to 100 mol of oxymethylene unit | mol | 1.5 | 1.5 | 1.5 | 1.5 | 1.5 | 1.5 | 1.5 |
| MI | g/10 min | 27 | 27 | 27 | 27 | 27 | 27 | 27 |
| Half crystallization time | sec | | 28 | | | 28 | | |
| Feed amount | kg/h · Line | 4 | 6 | 6 | 1 | 1 | 1 | 1 |
| Take-off rate | m/min | 4960 | 1980 | 3960 | 190 | 340 | 4960 | 5950 |
| Tensile elongation rate E1 of fiber after taking off | % | 80 | 420 | 200 | 800 | 500 | 40 | 30 |
| Rate of pre-drawing roller | m/min | 5000 | 2000 | 4000 | 200 | 350 | 5000 | 6000 |
| Rate of drawing roller | m/min | 6000 | 6000 | 6000 | 1520 | 1010 | 5550 | 6060 |
| Strain rate | l/min | 2000 | 8000 | 4000 | 2640 | 1320 | 1180 | 220 |
| Draw ratio | times | 1.2 | 3.0 | 1.5 | 7.6 | 2.9 | 1.1 | 1.0 |
| Tensile elongation rate E2 of fiber after drawing | % | 50 | 73 | 100 | 18 | 108 | 28 | 30 |
| Winding rate | m/min | 5980 | 5980 | 5980 | 1500 | 1000 | 5500 | 6000 |
| Number of holes of discharge nozzle | number | 36 | 36 | 36 | 36 | 36 | 48 | 48 |
| Single fiber thickness after drawing step | denier | 2.8 | 4.2 | 4.2 | 2.8 | 4.2 | 0.6 | 0.5 |
| (100 + E1)/Draw ratio | — | 150 | 173 | 200 | 118 | 208 | 89 | 98 |
| Evaluation results | | | | | | | | |
| Whiteness unevenness | — | A | A | A | D | D | A | A |
| Transparency | — | B | B | B | B | B | B | B |
| Spinnability | — | B | B | B | B | B | D | D |
| Secondary workability | — | B | C | C | B | D | D | D |
| Fineness unevenness (U %) | % | | 8 (8.0) | | | 30 | | |

Examples 25, 26 and 27

At the time of obtaining a crude oxymethylene copolymer, the amount of 1,3-dioxolane was changed. The crystallization time of each of the obtained oxymethylene copolymers is shown in Table 3. In addition, the spinning conditions were also changed as described in Table 3 and each polyacetal fiber was spun. The evaluation results are shown in Table 3.

Examples 28 and 29 and Comparative Examples 5 and 6

At the time of obtaining a crude oxymethylene copolymer, the amount of methylal as a viscosity modifier was changed. The crystallization time of each of the obtained oxymethylene copolymers is shown in Table 3. Relative to 100 parts by mass of trioxane, 0.03 parts by mass of methylal was added in Example 28, and 0.20 parts by mass of methylal was added in Example 29. In Comparative Example 5, methylal was not added. In Comparative Example 6, 0.40 parts by mass of methylal was added. In addition, the spinning conditions were also changed as described in Table 3 and each polyacetal fiber was spun. The evaluation results are shown in Table 3.

TABLE 3

| Physical properties or production conditions | Unit | Examples | | | | | Comparative Examples | |
|---|---|---|---|---|---|---|---|---|
| | | 25 | 26 | 27 | 28 | 29 | 5 | 6 |
| Content of oxyethylene unit relative to 100 mol of oxymethylene unit | mol | 0.5 | 5 | 5 | 1.5 | 1.5 | 1.5 | 1.5 |
| MI | g/10 min | 10 | 10 | 40 | 5 | 50 | 1 | 70 |
| Half crystallization time | sec | 9 | 240 | 330 | 32 | 30 | | |
| Feed amount | kg/h · Line | 1 | 1 | 1 | 1 | 1 | 1 | 1 |
| Take-off rate | m/min | 490 | 490 | 490 | 490 | 490 | 490 | 490 |
| Tensile elongation rate E1 of fiber after taking off | % | 350 | 400 | 400 | 250 | 400 | ND | ND |
| Rate of pre-drawing roller | m/min | 500 | 500 | 500 | 500 | 500 | 500 | 500 |
| Rate of drawing roller | m/min | 2020 | 2020 | 2020 | 1220 | 2020 | — | — |
| Strain rate | l/min | 3040 | 3040 | 3040 | 1440 | 3040 | — | — |
| Draw ratio | times | 4.0 | 4.0 | 4.0 | 2.4 | 4.0 | ND | ND |
| Tensile elongation rate E2 of fiber after drawing | % | 11 | 24 | 40 | 43 | 24 | ND | ND |
| Winding rate | m/min | 2000 | 2000 | 2000 | 1200 | 2000 | — | — |

TABLE 3-continued

| Physical properties or production conditions | Unit | Examples 25 | 26 | 27 | 28 | 29 | Comparative Examples 5 | 6 |
|---|---|---|---|---|---|---|---|---|
| Number of holes of discharge nozzle | number | 36 | 36 | 36 | 36 | 36 | 36 | 36 |
| Single fiber thickness after drawing step | denier | 2.1 | 2.1 | 2.1 | 3.5 | 2.1 | ND | ND |
| (100 + E1)/Draw ratio | — | 111 | 124 | 132 | 143 | 124 | ND | ND |
| Evaluation results | | | | | | | | |
| Whiteness unevenness | — | A | A | A | A | A | ND | ND |
| Transparency | — | B | B | B | B | B | ND | ND |
| Spantability | — | C | B | B | B | B | D | D |
| Secondary workability | — | B | B | B | C | B | ND | ND |
| Fineness unevenness (U %) | % | | | | | | | |

ND: unmeasurable,
—: No fiber was successfully obtained

As is clear from Tables 1-3, in Examples 1-29, it was demonstrated that a polyacetal fiber excellent in whiteness unevenness, spinnability and secondary workability can be obtained by carrying out spinning under conditions under which appropriate MI, E1, E2 and single fiber thickness of the polyacetal fiber after the drawing step are obtained. Moreover, in Examples 3, 4, 7, 10, 14-17, 19 and 23, U % was suppressed to a low level. Furthermore, in Examples 3, 15 and 25-29, the half crystallization time was good.

Meanwhile, in Comparative Example 1, since E1 was large, the obtained fiber was multipoint drawing and had whiteness unevenness. In Comparative Example 2, since E2 was large, similarly, the fiber had whiteness unevenness. In Comparative Examples 3 and 4, since the single fiber thickness of the polyacetal fiber after the drawing step was small, thread breakage occurred at the time of spinning and no fiber was successfully obtained.

Further, in Comparative Example 5 in which MI was 1 g/10 min, the fiber immediately hardened and it was difficult to carry out spinning. In Comparative Example 6 in which MI was 70 g/10 min, the fiber did not completely harden, spinnability was also deteriorated, and no fiber was successfully obtained.

Example 30

Among the spinning conditions, the rotation rate of the roller was changed from that of Example 3 in order to carry out drawing in two stages in the drawing step, and each polyacetal fiber was spun. The rotation rate of the pre-drawing roller was 350 m/min, the rotation rate of the first-stage drawing roller was 980 m/min, and the rotation rate of the second-stage drawing roller was 4550 m/min.

In this case, the tensile elongation rate E1 of the fiber after the take-off step was 500%, the tensile elongation rate E3 of the fiber after the first-stage drawing was 110%, and the tensile elongation rate E2 of the fiber after all the stages of the drawing step was 40%. The evaluation results are shown in Table 4.

Examples 31 and 32 and Comparative Example 7

The spinning conditions (take-off rate and winding rate) were changed from those of Example 30 in order to obtain the elongation rates described in Table 4, and each polyacetal fiber was spun. The evaluation results are shown in Table 4.

TABLE 4

| Physical properties or production conditions | Unit | Examples 3 | 30 | 31 | 32 | Comparative Example 7 |
|---|---|---|---|---|---|---|
| Take-off rate | m/min | 350 | 350 | 650 | 2970 | 350 |
| Tensile elongation rate E1 of fiber after taking off | % | 500 | 500 | 300 | 90 | 500 |
| Rate of pre-drawing roller | m/min | 350 | 350 | 660 | 3000 | 350 |
| Rate of drawing roller in first stage | m/min | 1530 | 980 | 1700 | 4200 | 500 |
| Tensile elongation rate E3 of polyacetal fiber after first-stage drawing of drawing step | % | — | 110 | 50 | 40 | 300 |
| Rate of drawing roller in second stage | m/min | — | 4550 | 1870 | 4850 | — |
| Winding rate | m/min | 1500 | 4500 | 1850 | 4800 | — |
| Tensile elongation rate E2 of polyacetal fiber after all stages of drawing step | % | 40 | 40 | 40 | 20 | ND |
| Evaluation results | | | | | | |
| Whiteness unevenness | | A | A | A | A | ND |
| Transparency | | B | B | B | B | ND |
| Spinnability | | B | B | A | A | D |
| Secondary workability | | B | B | A | A | ND |

ND: unmeasurable,
—: No fiber was successfully obtained

As is clear from Table 5, when spinning was carried out with two-stage drawing and under conditions under which the appropriate elongation rates were obtained in Examples 30-32, good results were obtained with respect to whiteness unevenness, spinnability and secondary workability. Meanwhile, in Comparative Example 7, it was difficult to carry out spinning Examples 33-36

The temperature of the pre-drawing roller and the temperature of the drawing roller were changed from those of Example 3, and each polyacetal fiber was spun. The evaluation results are shown in Table 5.

TABLE 5

| Physical properties or production | Unit | Examples 3 | 33 | 34 | 35 | 36 |
|---|---|---|---|---|---|---|
| Temperature of pre-drawing roller | ° C. | 140 | 140 | 145 | 130 | 135 |
| Temperature of drawing roller | ° C. | 145 | 145 | 155 | 150 | 155 |
| Difference between roller temperatures | ° C. | 5 | 0 | 10 | 20 | 20 |
| Evaluation results | | | | | | |
| Whiteness unevenness | | A | A | A | A | A |
| Transparency | | B | B | A | A | A |
| Spinnability | | B | C | A | A | B |
| Secondary workability | | B | B | B | B | B |

According to Table 5, when spinning was carried out at the appropriate roller temperatures under the appropriate conditions in Examples 34-36, good results were obtained with respect to transparency and spinnability.

The invention claimed is:

1. A method for producing a polyacetal fiber, wherein the polyacetal fiber is obtained by using an oxymethylene copolymer having a melt index of 5 to 60 g/10 min at 190° C. under a load of 2.16 kg, the method comprising:

taking off the polyacetal fiber from a discharge nozzle of a spinning apparatus; and drawing the taken-off polyacetal fiber, wherein:

the polyacetal fiber after the taking off has a tensile elongation rate E1 of 20 to 500%, and the polyacetal fiber after the drawing has a tensile elongation E2 of 10 to 100%;

E1≥E2; and the single fiber thickness of the polyacetal fiber after the drawing is 0.7 to 5.0 denier;

wherein the taking off and the drawing are carried out continuously.

2. The method according to claim 1, wherein the oxymethylene copolymer has a half crystallization time of 5 to 500 sec.

3. The method according to claim 1, wherein the oxymethylene copolymer has an oxymethylene unit and an oxyethylene unit, and wherein the content of the oxyethylene unit is 0.5 to 7.0 mol relative to 100 mol of the oxymethylene unit.

4. The method according to claim 1, wherein a draw ratio in the drawing satisfies formula (A) below:

$$110 \leq (100+E1)/\text{Draw ratio} \leq 200 \quad \text{(A).}$$

5. The method according to claim 1, wherein:

the drawing is carried out in two stages using a pre-drawing roller and two or more drawing rollers; and the tensile elongation rate E3 of the polyacetal fiber after the first-stage drawing is 10 to 150% and E1≥E3≥E2.

6. The method according to claim 1, wherein:

the drawing is carried out using a pre-drawing roller and two or more drawing rollers; and in the drawing, the polyacetal fiber is passed through the pre-drawing roller and then the two or more drawing rollers, and at least one of the two or more drawing rollers has a temperature that is 3 to 20° C. higher than a temperature of the pre-drawing roller.

7. The method according to claim 6, wherein in the drawing, the temperature of the pre-drawing roller and the temperature of at least one of the two or more drawing rollers are 130 to 155° C.

8. The method according to claim 1, wherein of the polyacetal fiber after the drawing has a fineness of 0.5 to 9%.

9. The method according to claim 1, wherein the tensile elongation E2 of the polyacetal fiber is 10 to 50%.

* * * * *